US005910073A

United States Patent [19]

Conner

[11] Patent Number: 5,910,073

[45] Date of Patent: Jun. 8, 1999

[54] APPARATUS FOR EXERCISING ABDOMINAL MUSCLES AND METHOD

[76] Inventor: Gary W. Conner, 1056 Quail Hill Ave., Newton, N.C. 28658

[21] Appl. No.: 09/175,889

[22] Filed: Oct. 20, 1998

Related U.S. Application Data

[63] Continuation-in-part of application No. 09/056,008, Apr. 6, 1998, which is a continuation-in-part of application No. 08/710,169, Sep. 12, 1996, Pat. No. 5,766,118

[60] Provisional application No. 60/008,814, Dec. 18, 1995.

[51] Int. Cl.[6] ..... A63B 00/69

[52] U.S. Cl. ..... 482/129; 482/121; 482/904

[58] Field of Search ..... 482/121–130, 482/904

[56] References Cited

U.S. PATENT DOCUMENTS

| | | | |
|---|---|---|---|
| 1,432,013 | 10/1922 | Blake | 482/124 |
| 4,762,318 | 8/1988 | Phillips et al. | 482/121 |
| 5,250,016 | 10/1993 | Higgins | 482/121 |
| 5,766,118 | 6/1998 | Conner | 482/129 |

*Primary Examiner*—Jerome Donnelly

[57] ABSTRACT

An exercise apparatus includes a clamping means for fixing the apparatus to a vertical surface such as a door or a wall, an elastic resistance band and a resistance harness. In a preferred embodiment, the clamping means is a lag screw having a hook portion adjacent one end. On end of the resistance band is attached to the hook portion of the lag screw and the other end is attached to the resistance harness. In another preferred embodiment, the apparatus further includes an adjustment for adjusting the vertical location of the resistance harness relative to the clamping means, and the clamping means is a U-shaped bracket. The adjustment means includes a belt having one end attached to the U-shaped bracket, and the free end threaded first through an adjustment buckle and then through a hook attached to one end of the resistance band. The other end of the resistance band is attached to the resistance harness. In an alternative embodiment, the resistance harness includes a hinged resistance bar so that the apparatus is easy to use, transport and store. In a preferred method of using the exercise apparatus, a user extends the upper arms through an opening defined by the resistance harness and pulls the resistance harness using the abdominal muscles in the direction of the pelvis while bowing the lower back outwardly posterior tilt to extend the resistance band. Thus, the spine is elongated and all of the abdominal muscle groups are contracted without placing undue stress on the muscles in the lower back.

6 Claims, 5 Drawing Sheets

11
20
22
31
30
12
10
32
41
40
53
42
51
52
50
56
59
56
54
58
57

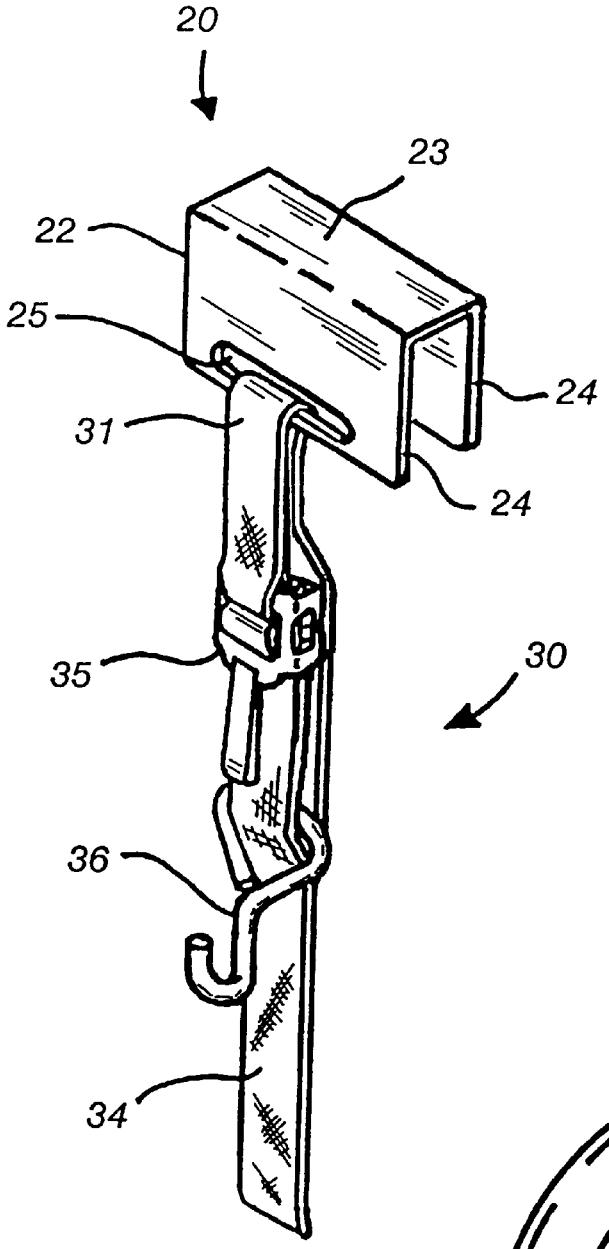
Fig. 4
Fig. 5
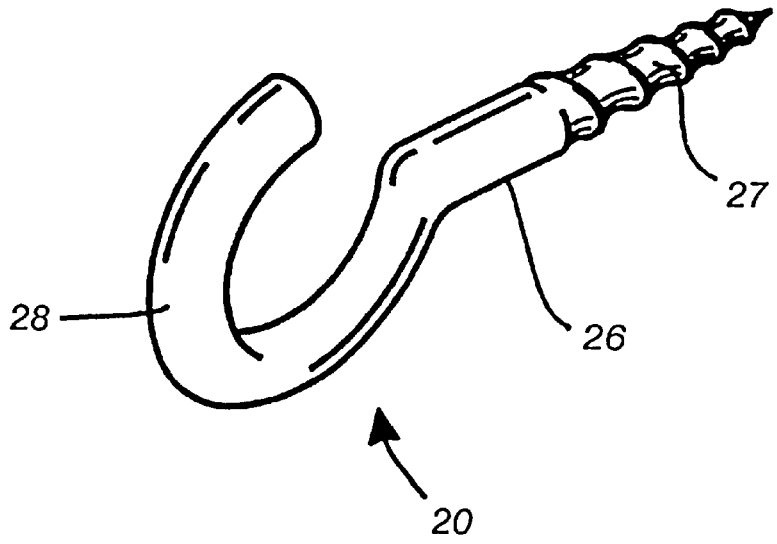

APPARATUS FOR EXERCISING ABDOMINAL MUSCLES AND METHOD

This application is a continuation-in-part of U.S. patent application Ser. No. 09/056,008, filed Apr. 6, 1998 which is a continuation-in-part of U.S patent application Ser. No. 08/710,169, filed Sep. 12, 1996, now U.S. Pat. No. 5,766, 118, which claims the benefit of U.S. Provisional Application Ser. No. 60/008,814 filed Dec. 18. 1995.

BACKGROUND OF THE INVENTION

1. Field of the Invention

This invention pertains to an exercise apparatus, and more particularly, to an apparatus for exercising the abdominal muscles in contraction and for elongating the spine without placing undue stress on the muscles in the lower back.

2. Description of the Prior Art and Objectives of the Invention

Situps have long been a popular exercise for strengthening and toning the abdominal muscles. Typically, a person performing a situp lies with the back and feet on a flat surface, and with the knees bent. The person then lifts the head and shoulders in the direction of the knees using the abdominal muscles. The hands may be placed behind the head with the elbows forward so that the elbows touch the knees when the head and shoulders are lifted. The conventional situp, however, places undue stress on the muscles in the lower back, causing discomfort during the exercise and often resulting in an injury.

As a result, the "crunch" style of situp has become a popular alternative to the conventional situp. Crunches are performed in the same manner as conventional situps, except that the head and shoulders are lifted only a limited distance so that less range of motion is required by the muscles in the lower back. Accordingly, the undue stress placed on the muscles in the lower back is not eliminated, but only reduced. In addition, crunches do not optimize the exercise benefit received by the abdominal muscles. In particular, the exercise benefit is lost which obtained by pulling the weight of the head and shoulders the additional distance in the direction of the knees.

A number of weight and "fitness" apparati have been developed recently for exercising the abdominal muscles. These apparati, however, for the most part reproduce the same range of motion as the situp and the crunch. Namely, the resistance produced by the apparatus is concentrated in the lower back and the upper body of the person using the apparatus. One such exercise apparatus is disclosed in U.S. Pat. No. 5,098,089. The '089 apparatus includes a triangular frame for mounting a bed on which the body of the user is supported, knee posts for supporting the knees of the user, and foot posts for receiving the feet and ankles of the user. The frame acts as a fulcrum so that the bed pivots about a transverse axis to permit the user to perform situps with the head elevated above the feet. Accordingly, the user obtains the exercise benefit of the full range of motion of a conventional situp without having to overcome the force of gravity to raise the upper body above the elevation of the feet and knees. Although the '089 exercise apparatus alleviates a portion of the undue stress placed on the muscles in the lower back, it does not increase the exercise benefit obtained by the abdominal muscle groups.

U.S. Pat. No. 5,120,052 to Evans discloses an abdominal exercise apparatus that develops the abdominal muscles through their entire range of motion. The objective of the apparatus is to develop the abdominal muscles not only through contraction, but through increased elongation as well. The apparatus includes a convex arch which engages the upper lumbar and lower thoracic spine in the area of the lower back of the user. The arch permits the user's spine to be supported while allowing the spine to bow outwardly the range that occurs in a normal standing posture. The apparatus further includes an adjustable knee retainer that restrains upward movement of the knees so that the lower back maintains contact with the arch. Accordingly, the range of motion experienced during the situp is increased so that the abdominal muscles are elongated as well as contracted during the exercise. Although the Evans apparatus alleviates a portion of the undue stress placed on the muscles in the lower back and increases the exercise benefit obtained by the muscles in the lower back, it does not significantly increase the exercise benefit obtained by the abdominal muscle groups.

U.S. Pat. No. 5,238,435 to Ricks discloses an exercise apparatus for building stronger stomach muscles. The apparatus includes a pair of foot rests for anchoring the feet of the user in a vertical or inclined orientation. The foot rests immobilize the feet of the user while the user performs a conventional situp. Accordingly, the exercise benefit obtained by the abdominal muscles is somewhat increased by the additional resistance provided by the foot rests. However, the Ricks exercise apparatus placed undue stress on the muscles in the lower back, and only some of the abdominal muscles obtain an increased exercise benefit (i.e., the muscles utilized in performing a conventional situp).

Each of the above exercise apparati place undue stress on the muscles in the lower back and do not provide optimum exercise benefit to all of the abdominal muscle groups. It is apparent that an exercise apparatus that overcomes one or more of the limitations of the exercise apparati described above would be advantageous. In particular, it would be advantageous to provide an exercise apparatus which focuses the benefit of the exercise on all of the abdominal muscle groups, and which does not place undue stress on the muscles in the lower back of the user.

Accordingly, it is an object of the invention to provide an exercise apparatus which works all of the abdominal muscle groups.

It is another object of the invention to provide an exercise apparatus which does not place undue stress on the muscles in the lower back of the user.

It is another, and more particular, object of the invention to provide an exercise apparatus which causes all of the abdominal muscle groups to contract in the direction of the posterior side of the user's body.

It is another object of the invention to provide an exercise apparatus which is lightweight and compact, and thus is convenient to use, transport and store.

The invention disclosed and shown in the accompanying figures provides such an exercise apparatus including additional features which will be more fully described hereinafter.

SUMMARY OF THE INVENTION

The invention is an exercise apparatus for developing the abdominal muscle groups and elongating the spine of the user without placing undue stress on the muscles in the lower back of the user. The apparatus accomplishes the above objective by providing for a range of motion of at least about 90 degrees while the abdominal muscle groups are contracted in the direction of the posterior side of the user's body. The apparatus may be used for toning and conditioning the abdominal muscles, and may be used to rehabilitate the spine while relieving the pressure normally exerted on the muscles in the lower back.

The exercise apparatus includes a clamping means for fixing the apparatus to a vertical surface, at least one resistance band and a resistance harness. In a preferred embodiment, one end of the resistance band is attached to the clamping means, and the other end of the resistance band is attached to the resistance harness. In another preferred embodiment, the exercise apparatus further includes an adjustment means for adjusting the exercise apparatus vertically to accommodate persons of different heights. One end of the adjustment means is attached to the clamping means and the other end is attached to one end of the resistance band. The other end of the resistance band is attached to the resistance harness.

In a preferred embodiment, the clamping means includes a U-shaped bracket made of a thin, formable material, such as sheet metal or plastic. The inside surface of the bracket engages the top edge of a conventional door so that the exercise apparatus hangs freely from the door under the influence of gravity, but is resisted against downward movement. The bracket includes a base and pair of spaced apart legs depending from the base. An elongate slot is formed in at least one of the legs of the bracket for receiving one end of the adjustment means.

In an alternate embodiment, the clamping means includes an elongate lag screw for engaging a vertical wall. The lag screw includes an externally threaded portion adjacent one end for threading the clamping means into the vertical wall. A hook portion is formed adjacent the other end of the lag screw for accepting one end of the resistance band. A triangular shaped fitting, or a fitting having a slot formed therein, may be provided adjacent the other end of the lag screw instead of the hook portion so that one end of the adjustment means may be attached to the clamping means and the other end attached to the resistance band as previously described.

The adjustment means preferably includes a thin, narrow, elongate adjustment belt made of a substantially non-elastic material, such as fabric or soft plastic. One end of the belt is threaded first through the slot formed in the bracket of the clamping means, and next through an adjustment buckle. The end of the belt is then secured to itself in any conventional manner. The free end of the belt is threaded first through a hook for engaging the one end of the resistance band, and next through the opposite side of the adjustment buckle. The elevation of the hook relative to the bracket may be increased or decreased as required by feeding the free end of the adjustment belt through the adjustment buckle in a known manner.

The resistance band preferably includes a thin, narrow, elongate and made of an elastic material, such as rubber, which is formed into a closed loop. As previously described, one end of the resistance band is attached to the hook portion of the clamping means, or to the hook of the adjustment means. The other end of the resistance band is then attached to the resistance harness. A plurality of resistance bands may be used to increase the cumulative amount of resistance against downward movement provided by the exercise apparatus, or to restrict the range of motion experienced by the user during the exercise.

The resistance harness preferably includes attachment means for attaching the resistance harness to the resistance band, an elongate resistance bar fr receiving the upper arms of the user thereon, and at least one connecting strap for connecting the resistance bar to the attachment means. The attachment means preferably includes a thin, elongate rod having a hook portion extending outwardly from the rod for engaging the resistance band. The connecting strap preferably includes a pair of connecting straps, each having one end secured to an end of the rod of the attachment means and a second end secured to an end of the resistance bar. The resistance bar preferably includes a thin, elongate inner bar made of a rigid material, such as metal or hard plastic, and a thick, elongate outer pad disposed concentrically about the inner bar and made of a flexible material such as soft rubber or polyvinyl chloride (PVC) foam.

In an alternate embodiment, the inner bar is formed in opposed halves and includes a hinge joint so that the halves may be folded against one another. Thus, the length of the inner bar may be easily and rapidly reduced to about one-half of its extended length.

The exercise apparatus of the invention exercises the abdominal muscle groups and elongates the spine of the user without placing undue stress on the muscles in the lower back of the user. The exercise apparatus is secured to a vertical surface, such as a door or a wall by the clamping means. The user is preferably seated on a chair or bench with the upper arms extended through the resistance harness and resting on the outer pad of the resistance bar. The suer adjusts the vertical location of the exercise apparatus (if necessary) using the adjustment means so that the user's back is straight and the resistance band is relaxed, but taut.

In a preferred method of using the exercise apparatus, the user rotates the upper body about the pelvis and pulls the resistance bar in the direction of the pelvis using the abdominal muscles while tilting the pelvis to bow the lower back outwardly so that abdominal muscle groups are contracted and the spine is elongated while relieving the downward pressure on the resistance bar so that the tension in the resistance band is relaxed.

In another preferred method of using the exercise apparatus, the user pulls the resistance bar in the direction of the pelvis using the abdominal muscles while tilting the pelvis to bow the lower back outwardly into a posterior pelvic tilt so that the abdominal muscle groups are contracted and the spine elongated, without rotating the upper body about the pelvis. The resistance in the opposite direction provided by the extension of the resistance band exercises all of the abdominal muscle groups in contraction as opposed to extension. The user then relieves the downward pressure on the resistance bar so that the tension in the resistance band is relaxed.

BRIEF DESCRIPTION OF THE DRAWINGS

FIG. 4 depicts a preferred embodiment of the clamping means and the adjustment means of the invention;

FIG. 5 represents another preferred embodiment of the clamping means of the invention.

DETAILED DESCRIPTION OF THE PREFERRED EMBODIMENT AND OPERATION OF THE INVENTION

Figure 1:
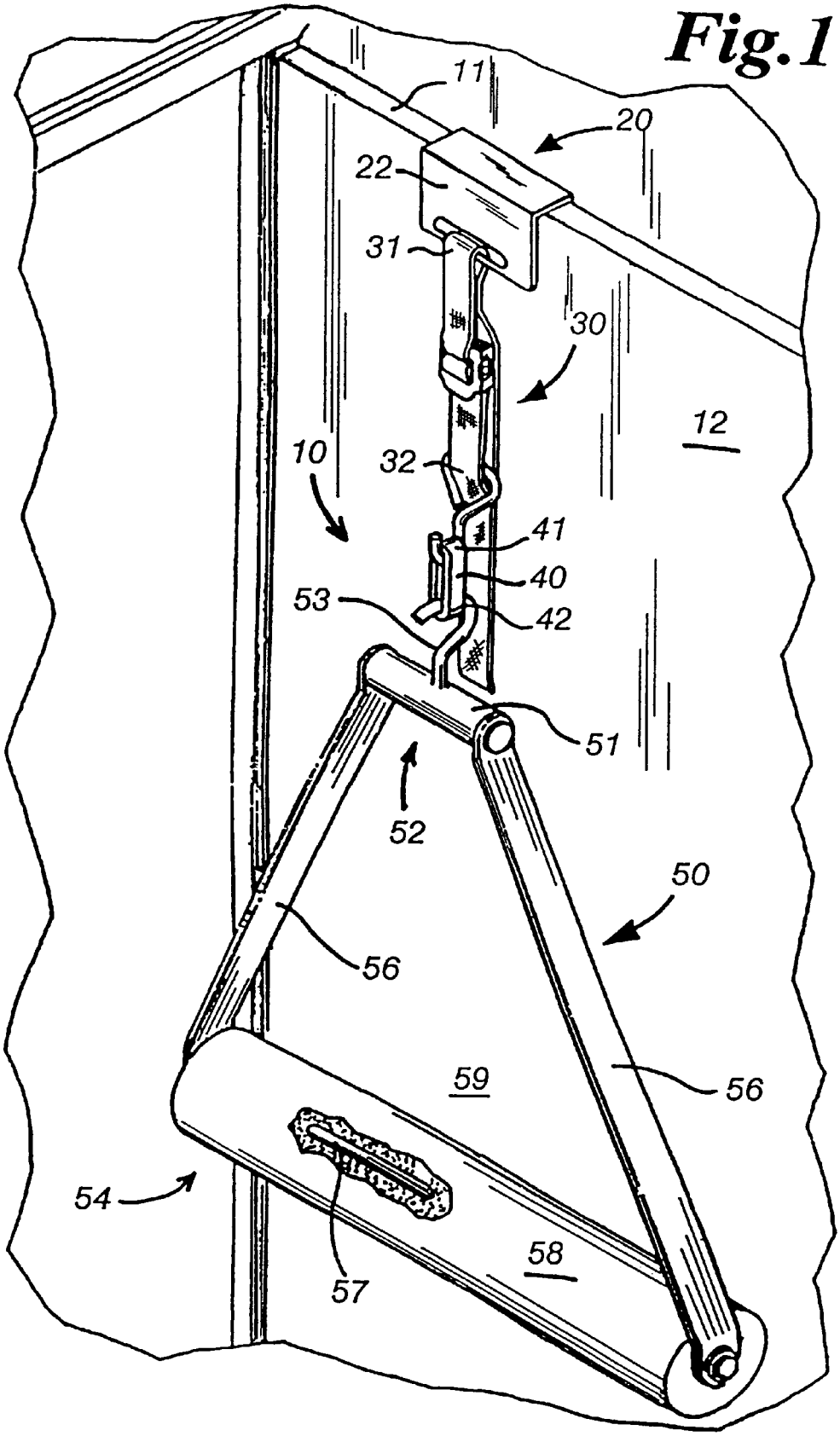
FIG. 1 shows a an environmental perspective view of an exercise apparatus according to the invention.

Referring now to the drawings, wherein like numerals indicate like elements, FIG. 1 is an environmental view of a preferred embodiment of an exercise apparatus, indicated generally at 10, according to the invention. Exercise apparatus 10 enables a user to develop the abdominal muscle groups and elongate the spine without placing undue stress on the muscles in the lower back. Exercise apparatus 10 provides for a range of motion of at least about 90 degrees while the abdominal muscle groups are contracted in the direction of the posterior side of the user's body. The apparatus 10 may be used for toning and conditioning the abdominal muscles, and may be used to rehabilitate the spine while relieving the pressure normally exerted on the muscles in the lower back.

Apparatus 10 comprises clamping means 20 for fixing apparatus 10 to a vertical surface, at least one resistance band 40 and resistance harness 50. In a preferred embodiment, (FIGS. 2*a* and 2*b*), one end 41 of resistance band 40 is attached directly to clamping means 40, and other end 42 of resistance band 40 is attached to resistance harness 50. In another preferred embodiment (FIGS. 3*a* and 3*b*), exercise apparatus 10 further comprises adjustment means 30 for adjusting apparatus 10 vertically to accommodate persons of different heights. One end 31 of adjustment means 30 is attached directly to clamping means 20, and other end 32 of adjustment means 30 is attached to end 41 of resistance band 40. As before, end 42 of resistance band 40 is attached to resistance harness 50.

Figure 2B:
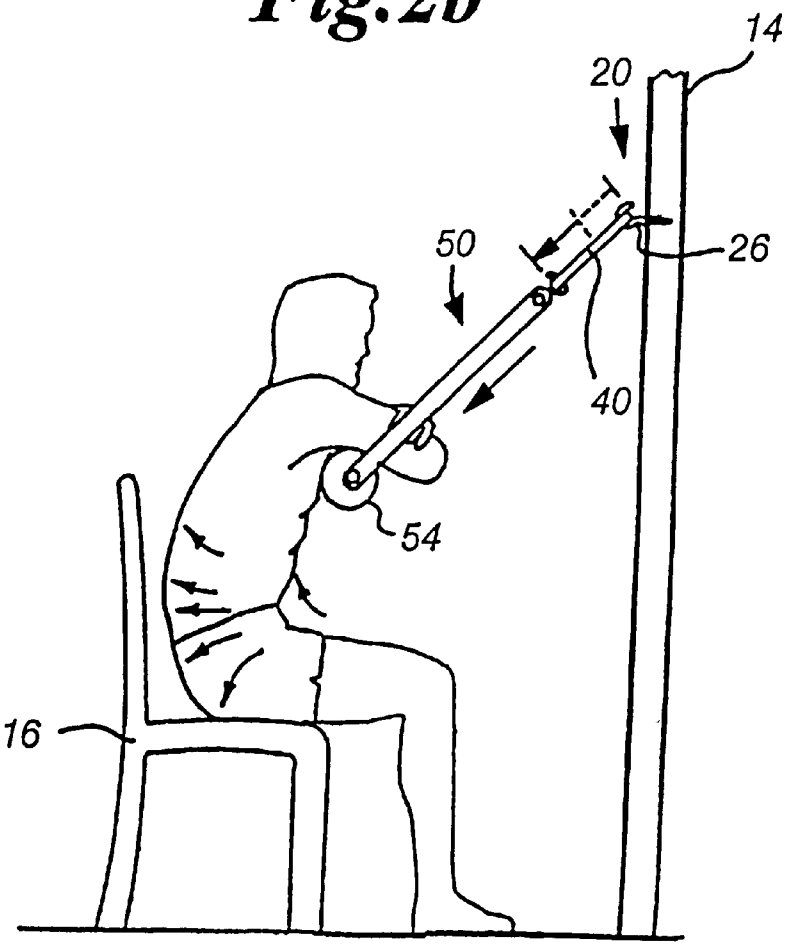
FIG. 2*b* demonstrates the terminal position of the exercise apparatus as used in FIG. 2*a;*
Figure 2A:
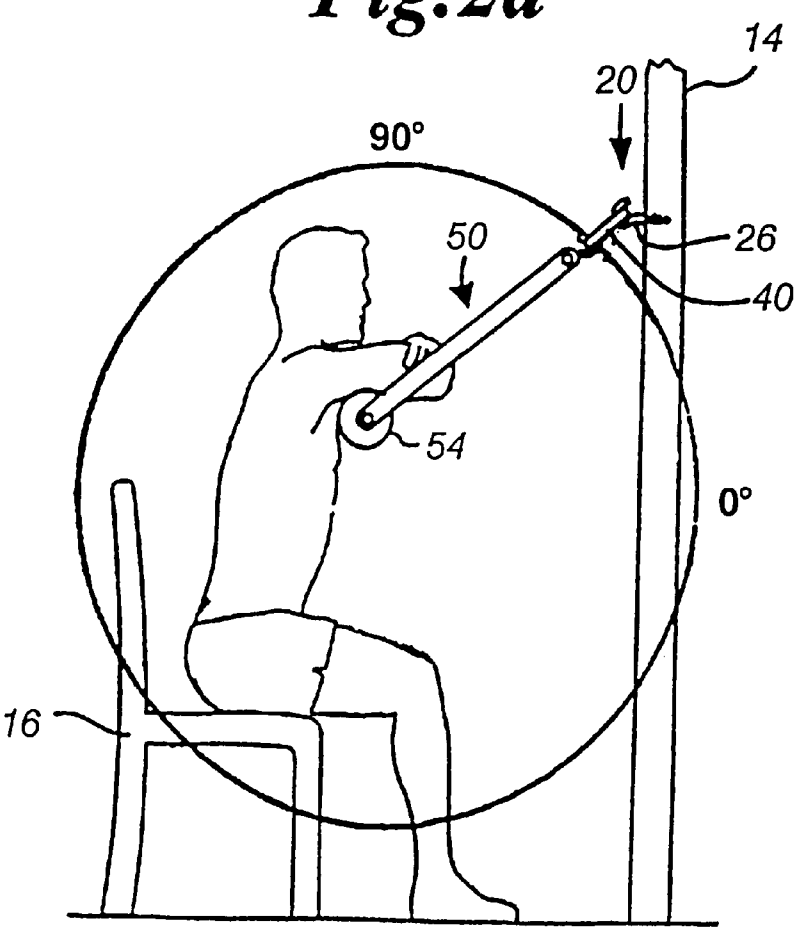
FIG. 2*a* illustrates a preferred method of the starting position of using an exercise apparatus according to the invention.
Figure 3B:
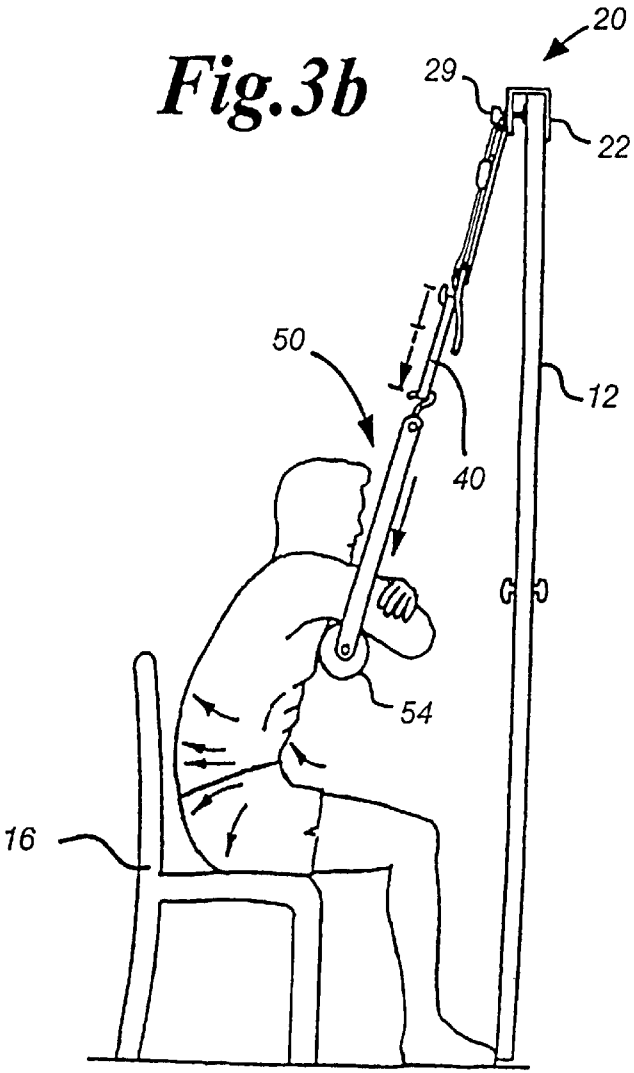
FIG. 3*b* pictures the preferred method of FIG. 2*b* of using the preferred embodiment of the exercise apparatus of FIG. 1.
Figure 3A:
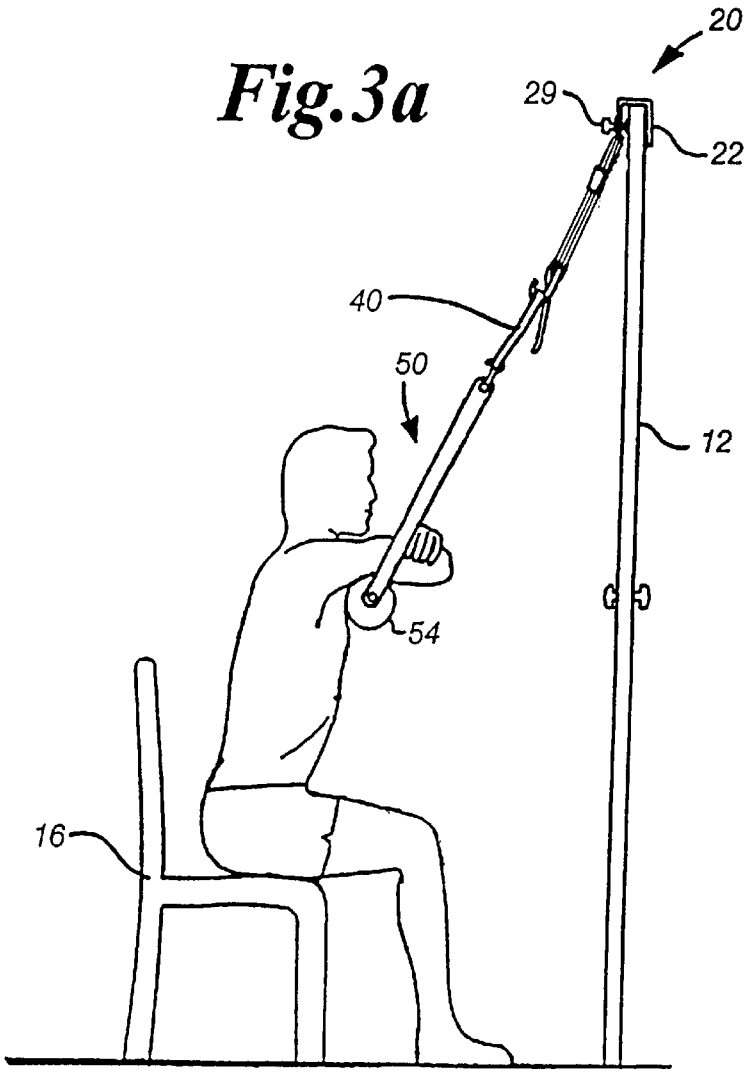
FIG. 3*a* features the preferred method of FIG. 2*a* of using the preferred embodiment of the exercise apparatus of FIG. 1.

Clamping means 20 fixes apparatus 10 to a vertical surface, such as door 12 (FIGS. 1, 3*a* and 3*b*) or to a wall 14 (FIGS. 2*a* and 2*b*). In a preferred embodiment, clamping means 20 comprises U-shaped bracket 22 made of a thin, formable material, such as sheet metal or plastic. Inside surface 21 of bracket 22 engages top edge 11 of conventional door 12 so that apparatus 10 hangs freely from door 12 under the influence of gravity, but is resisted against downward movement. As best shown in FIG. 4, bracket 22 preferably comprises base 23 and pair of spaced apart legs 24 depending from base 23. Elongate slot 25 is formed in at least one of legs 24 of bracket 22 for receiving end 31 of adjustment means 30. As shown in FIGS. 3*a* and 3*b*, clamping screw 29 may be provided through an aperture formed in leg 24 to permit bracket 22 to be used with door 12 which is less than standard thickness.

In an alternate embodiment, clamping means 20 comprises elongate lag screw 26 made of a rigid material, such as metal or hard plastic, for engaging vertical wall 14. As best shown in FIG. 5, lag screw 26 comprises externally threaded portion 27 adjacent one end for threading clamping means 20 into vertical wall 14. Hook portion 28 is formed adjacent the other end of lag screw 26 for accepting end 41 of resistance band 40. A triangular shaped fitting (not shown), or a fitting having a slot formed therein (not shown), may be provided adjacent the other end of lag screw 26 instead of hook portion 28 so that end 31 of adjustment means 30 may be attached to end 41 of resistance band 40 as previously described.

As best shown in FIG. 4, adjustment means 30 preferably comprises thin, narrow, elongate adjustment belt 34 made of a substantially non-elastic material, such as fabric or soft plastic. One end of belt 34 is threaded first through slot 25 formed in bracket 22 of clamping means 20, and next through adjustment buckle 35. The end of belt 34 is then secured to itself in a conventional manner, such as by sewing, stapling or riveting. The free end of belt 34 is threaded first through hook 36 for engaging end 41 of resistance band 40, and next through the opposite side of adjustment buckle 35. Accordingly, adjustment means 30 connects clamping means 20 to resistance band 40 while permitting the user to adjust the location of resistance harness 50 relative to the upper arms of the user. The elevation of hook 36 relative to bracket 22 may be increased or decreased as required by feeding the free end of adjustment belt 34 through adjustment buckle 35 in a known manner.

Resistance band 40 preferably comprises a thin, narrow elongate band made of an elastic material, such as rubber, which is formed into a closed loop. As previously described, end 41 of resistance band 40 is attached to hook portion 28 of clamping means 20, or to hook 36 of adjustment means 30. End 42 of resistance band 40 is attached to resistance harness 50. Elastic resistance band 40 provides increasing resistance as resistance harness 50 is pulled downward and resistance band 40 is extended. A plurality of resistance bands 40 may be used to increase the cumulative amount of resistance against downward movement provided by exercise apparatus 10, or to restrict the range of motion experienced by the user during the exercise. Thus, as the abdominal muscles of the user strengthen, additional resistance bands 40 may be used to increase the exercise benefit obtained by the abdominal muscle groups. Preferably the plurality of resistance bands 40 each have the same length and elasticity. However, a plurality of resistance bands 40 may be provided having different lengths and/or elasticities so that a user may also adjust the amount of extension provided by the resistance bands 40, and thus the amount of contraction experienced by the abdominal muscle groups.

Resistance harness 50 preferably comprises attachment means 52 for attaching resistance harness 50 to resistance band 40, an elongate resistance bar 54 for receiving the upper arms of the user thereon, and at least one connecting strap 56 for connecting resistance bar 54 to attachment means 52. Attachment means 52 is made of a rigid material, such as metal or hard plastic, and preferably comprises thin, elongate rod 51 having hook portion 53 extending outwardly from rod 51 for engaging end 42 of resistance band 40. Connecting strap 56 preferably includes a pair of connecting straps, each one having one end secured to an end of rod 51 of attachment means 52, and a second end secured to an end of resistance bar 54, so that resistance bar 54 is secured to attachment means 52.

Resistance harness 50 defines triangular opening 59 formed by relatively short rod 51 of attachment means 52, connecting straps 56, and relatively long resistance bar 54. Thus, a user may extend the upper arms through opening 59 and position the upper arms over resistance bar 54 for a purpose to be described hereinafter. Resistance bar 54 preferably includes thing, elongate inner bar 57 made of a rigid material, such as metal, hard plastic, or a reinforced composite material, and thick outer pad 58 disposed concentrically about inner bar 57, and made of a flexible material, such as soft rubber or polyvinylchloride (PVC) foam. Inner bar 57 provides stiffness to prevent resistance bar 54 from bending under the force exerted by the upper arms of the user. Outer pad 58 provides a soft, resilient surface for supporting the upper arms of the user.

Figure 6:
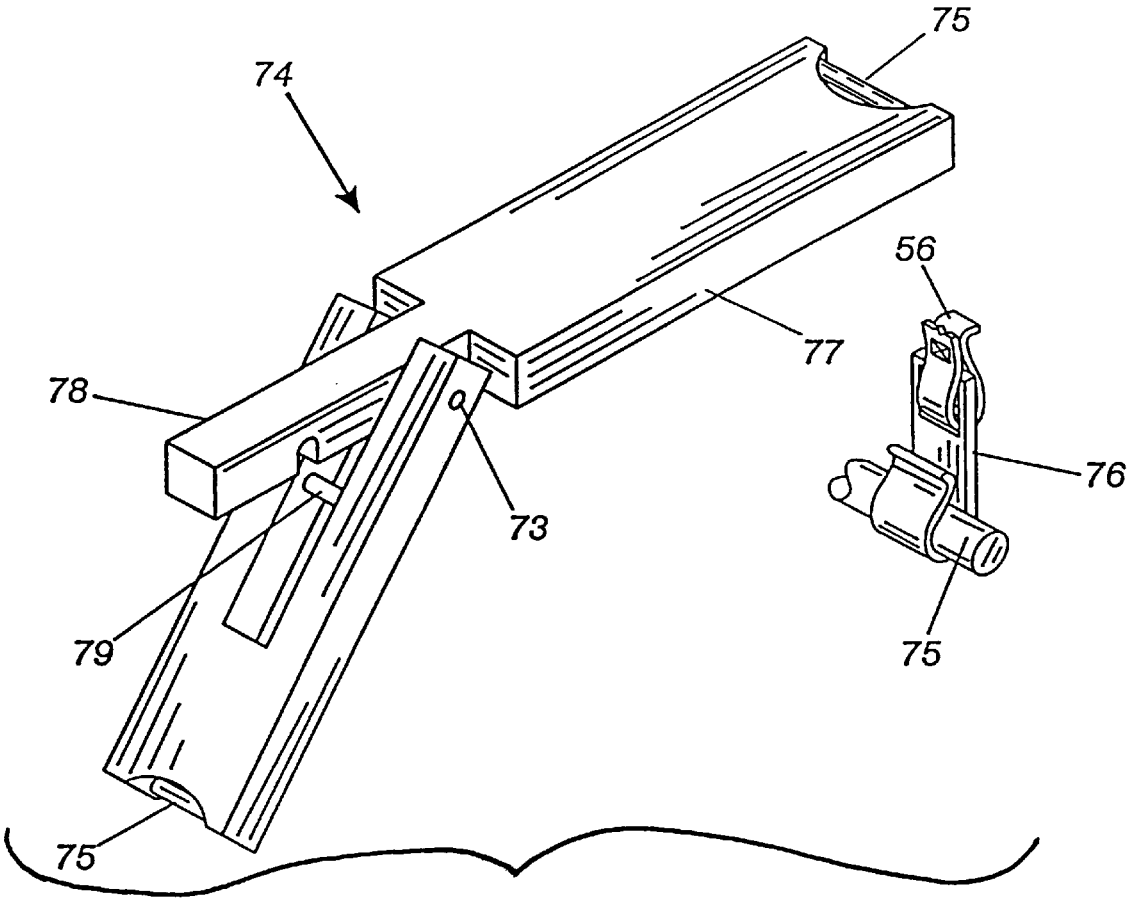
FIG. 6 shows another embodiment of the exercise apparatus of FIG. 1.

In an alternate embodiment of the invention, inner bar 57 of resistance bar 54 is collapsible so that apparatus 10 may be easily transported and stored. Thus, apparatus 10 is compact enough to be carried in a user's luggage when traveling away from home. As best shown in FIG. 6, inner bar 77 of resistance bar 74 is formed in opposed halves and includes hinge joint 73 so that the halves may be folded downwardly against one another to form the armrest extending between connecting straps 56 of resistance harness 50. Thus, the length of inner bar 77 may be easily and rapidly reduced to about one-half of its extended length. Preferably, one half on inner bar 77 is U-shaped and the opposed half comprises finger 78 which is received within the opening defined by the U-shaped half when inner bar 77 is extended. A notch formed in the underside of finger 78 cooperates with first transverse shaft 79 in the opening of the U-shaped half to provide a mechanical stop to prevent inner bar 77 from extending beyond horizontal. Preferably, each end of inner bar 77 comprises second transverse shafts 75 for receiving resilient clip 76 thereon to secure connecting straps 56 which connects resistance bar 74 to attachment means 52. Accordingly, resistance bar 74 may be extended and collapsed without the need to disassemble resistance harness 50. Resistance bar 74 may also include an outer pad affixed to the upper surfaces of the respective halves of inner bar 77 to provide additional comfort. Further longitudinal ribs may be formed in the underside of each half of inner bar 77 to provide additional stiffness while further reducing the weight of apparatus 10.

Exercise apparatus 10 permits a user to exercise the abdominal muscle groups and elongate the spine of the user without placing undue stress on the muscles of the lower back. As previously described, apparatus 10 is secured to a vertical surface, such as door 12 or wall 14, by clamping means 20. The user is preferably seated on a bench or chair 16 with the upper arms extended through opening 59 defined by resistance harness 50 and resting on outer pad 58 of resistance bar 54. If necessary, the user first adjusts the vertical location of apparatus 10 using adjustment means 30 so that the user's back is straight and resistance band 40 is relaxed, but taut.

In a preferred method of using apparatus 10 illustrated in FIGS. 2*a* and 3*a*, the user pulls resistance bar 54 in the direction of the pelvis using the abdominal muscles while tilting the pelvis to bow the lower back outwardly so that the abdominal muscle groups are contracted and the spine is elongated (as indicated by the arrow), without rotating the upper body about the pelvis. The resistance in the opposite direction provided by extension of resistance band 40 (indicated by the dashed arrow) exercises all of the abdominal muscle groups in contraction as opposed to extension. The user then relieves the downward pressure on resistance bar 54 so that the tension in resistance band 40 is relaxed. This preferred method of using apparatus 10 is particularly beneficial to increase the degree of contraction of the abdominal muscle groups without placing undue stress on the muscles in the lower back.

From the foregoing detailed description, it is readily apparent that the preferred embodiments of apparatus 10 and the preferred method of using exercise apparatus 10 disclosed herein permit a user to exercise all of the abdominal muscle groups and elongate the spine without placing undue stresses on the muscles in the lower back. Apparatus 10 increases the range of motion, and increases the degree of contraction of the abdominal muscle groups experienced by the user during the exercise.

The preceding recitation is provided as an example of the preferred embodiments and is not meant to limit the nature of scope of the present invention or appended claims.

I claim:

1. An apparatus for exercising the abdominal muscles, said apparatus comprising:

a) clamping means for fixing the apparatus to a vertical surface;

b) at least one elongate, elastic resistance band having opposed ends, one the opposed ends of said resistance band attached to said clamping means; and c) a resistance harness, said resistance harness comprising:

i) attachment means for attaching said resistance harness to the other of the opposed ends of said at least one resistance band;

ii) an elongate collapsible resistance bar having opposed ends, said resistance bar comprising an inner bar formed of opposed halves and a hinge joint for folding said opposed halves against one another; and iii) at least one connecting strap having a first end secured to said resistance bar and a second end secured to said attachment means.

2. An apparatus according to claim 1 comprising a plurality of said resistance bands for varying the cumulative resistance which a user must overcome when exercising the abdominal muscles.

3. An apparatus according to claim 1 further comprising an elongate, substantially non-elastic adjustment belt having opposed ends, one of the opposed ends of said adjustment belt attached to said clamping means, and wherein said clamping means comprises a U-shaped bracket for engaging the upper edge of a door, said bracket comprising a base, a pair of spaced apart legs depending downwardly therefrom and an elongate slot formed in one of said spaced apart legs for accepting said one of the opposed ends of said adjustment belt.

4. An apparatus according to claim 1 further comprising an elongate, substantially non-elastic adjustment belt having opposed ends, one of the opposed ends of said adjustment belt attached to said clamping means, and wherein said clamping means comprises a screw for engaging the surface of a vertical wall, said screw comprising an externally threaded portion adjacent one end for engaging the wall and a fitting formed in the other end for accepting said one of the opposed ends of said adjustment belt.

5. An apparatus according to claim 3 wherein said adjustment belt comprises a hook portion for attaching said other of the opposed ends of said adjustment belt to said one of the opposed ends of said at least one resistance band.

6. A method of exercising the abdominal muscles using the apparatus of claim 1, said method comprising the steps of:

positioning the upper arms over the collapsible resistance bar attached to one end of the at least one elastic resistance band, the other end of the elastic resistance band secured to a vertical surface; and pulling the resistance bar in the direction of the pelvis using the abdominal muscles while tilting the pelvis to bow the lower back outwardly so that the abdominal muscles are contracted.

* * * * *